US005349990A

United States Patent [19]

Gacsay

[11] Patent Number: 5,349,990

[45] Date of Patent: Sep. 27, 1994

[54] DEVICE FOR HOLDING WEFT THREADS FOR SERIES-SHED LOOMS

[75] Inventor: Lorant Gacsay, Zürich, Switzerland

[73] Assignee: Sulzer Rueti AG, Rueti, Switzerland

[21] Appl. No.: 78,480

[22] Filed: Jun. 17, 1993

[30] Foreign Application Priority Data

Aug. 11, 1992 [EP] European Pat. Off. ..... 92810607

[51] Int. Cl.[5] ..... D03D 41/00

[52] U.S. Cl. ..... 139/194; 139/28; 139/302

[58] Field of Search ..... 139/194, 450, 11, 28, 139/302

[56] References Cited

U.S. PATENT DOCUMENTS

| | | | |
|---|---|---|---|
| 3,792,723 | 2/1974 | Titov | 139/194 |
| 4,088,159 | 5/1978 | Komarov et al. | 139/194 |
| 4,290,458 | 9/1981 | Steiner | 139/28 |
| 4,587,996 | 5/1986 | Steiner | 139/194 |

FOREIGN PATENT DOCUMENTS

| | | |
|---|---|---|
| 0148292 | 7/1985 | European Pat. Off. . |
| 334277 | 1/1959 | Switzerland . |
| 337154 | 4/1959 | Switzerland . |

*Primary Examiner*—Andrew M. Falik

*Attorney, Agent, or Firm*—Townsend and Townsend Khourie and Crew

[57] ABSTRACT

A device or holding weft threads of a series-shed loom between a weft input side and a weft output side of a rotating rotor. The device includes one thread-holding device on the input side of the rotor, and one thread-holding device on the output side of the rotor, with at least one cutting device on the input side for severing inserted weft threads. Each weft thread holding device includes a device for clamping at least one weft thread at a first end on the input side, and at a second end on the output side. Each device for clamping includes a supporting surface extending substantially parallel to the central axis of rotation of the rotor and any device two endless conveyor belts lying over one another at least inside an angle of partial revolution of said rotor between said weft thread insertion angle to a weft thread discharge angle. The two conveyor belts are guided over guide rollers, so that an inlet slot for weft threads is produced in conjunction with the supporting surface. The conveyor belts move to capture the weft threads in the direction of rotation of the rotors. The distance of the supporting surface is increased within the angle of rotation from a first distance to a greater distance, whereby the weft thread is gripped between the clamping slots and moves away with respect to the center of rotation of the rotor to a release point with respect to the rotating rotor.

19 Claims, 6 Drawing Sheets

DEVICE FOR HOLDING WEFT THREADS FOR SERIES-SHED LOOMS

The invention relates to a device for holding weft threads for series-shed looms.

After the weft thread has been inserted and separated on the weft input side in a series-shed loom, the weft thread is to be held at the weft thread ends protruding on both sides from the rotating rotor until the time of the beat-up at the fabric.

BACKGROUND OF THE INVENTION

From Steiner U.S. Pat. No. 4,587,996 issued May 13, 1986 entitled WEFT YARD CONTROL FOR A WEAVING MACHINE ROTOR is known a device for grasping and holding weft thread ends (in) series-shed looms, in which the inserted weft thread is held in the rotating rotor on both sides by a clamping wire spring. The stationary weft thread clamping device comprises a rectilinear clamping groove, which extends over several reed spacing angles.

This device has several disadvantages. The weft thread ends, which are inserted by the rotor movement into the clamping groove and are further displaced, are subject to a rocking stress before leaving the clamped position, which results in the weft ends being crushed, breaking or prematurely sliding out of the clamping groove, for example. The fact that, because of the rectilinear path of the groove, the position of the clamped weft thread ends does not agree with the position of the weft thread rotating in the shed on an approximately circular path, also has a disadvantageous effect. This results in the weft thread being deviated at the transition point between the rotor and the clamping groove and as a result not being cleanly beaten up at the fabric, and/or defective edges being produced.

SUMMARY OF THE INVENTION

The object of the present invention is to hold the weft thread of series-shed looms gently in a predominantly stretched position between cutting and the beat-up at the fabric.

The advantages of the invention are regarded as being that the weft holding device is actively driven so that the weft thread ends held are actively moved on a path adapted to the movement of the rotor. The weft thread can therefore be supplied to the beat-up edge predominantly in the stretched condition. The active drive also permits the course of the angular velocity of the weft thread held to be adjusted so that it differs from the angular velocity of the rotor, which is normally constant. As a result the weft threads can be withdrawn from the weft channel in a particularly gentle manner, for example.

BRIEF DESCRIPTION OF THE DRAWINGS

Other objects, features and advantages of this invention will become more apparent after referring to the following specification and attached drawings in which.

DESCRIPTION OF THE PREFERRED EMBODIMENT

Figure 1:
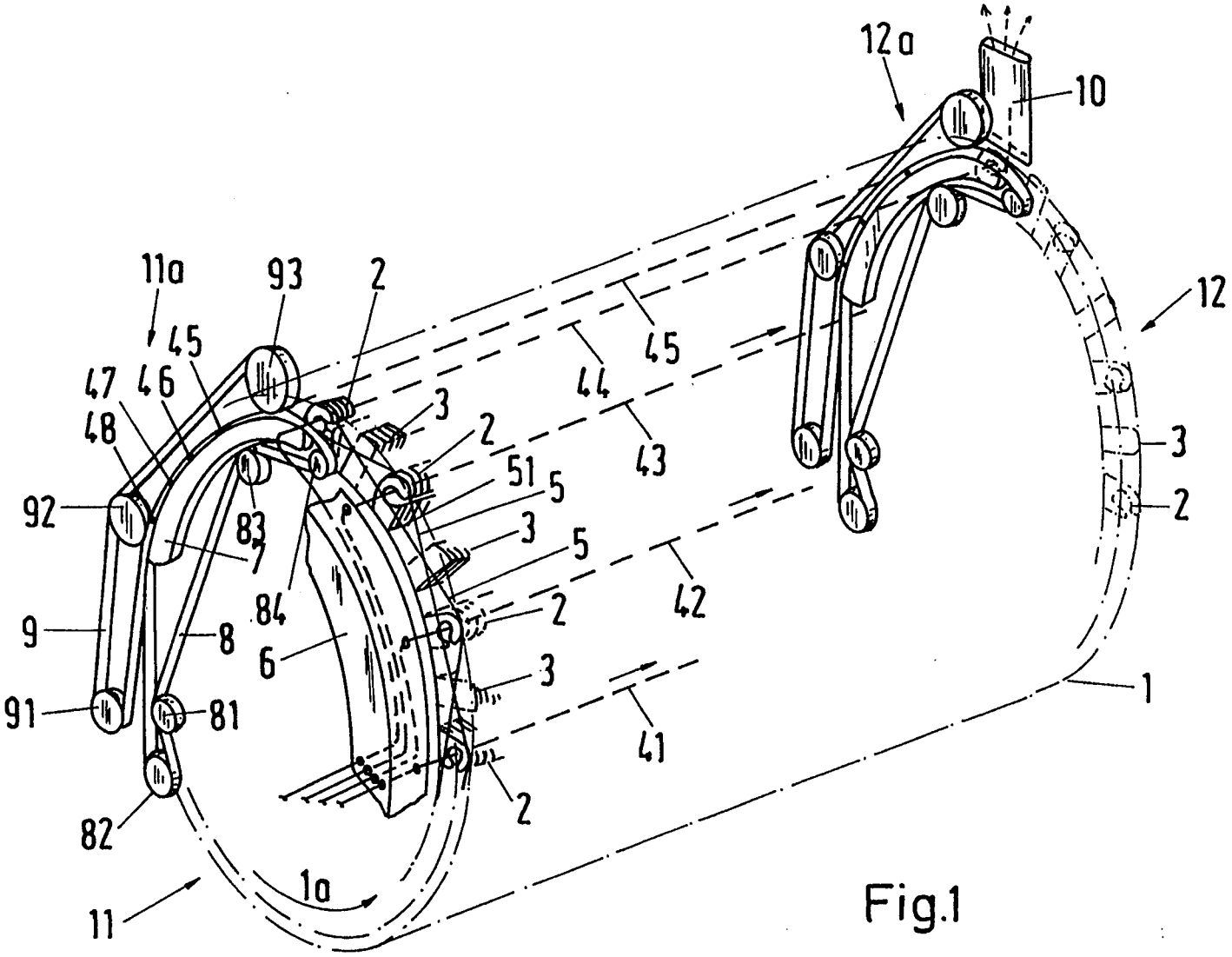
FIG. 1 shows a perspective view of the rotor and also of two weir holding devices.

FIG. 1 shows a rotor 1 with direction of rotation 1*a*, on the periphery of which guide elements 2 and guide elements 21 to 24 respectively are disposed, which comprise shedding high points 2H and low points 2T respectively, in which the warp threads 5 lie. To beat up the weft threads 41–48 at the beat-up edge 17 are used weaving reeds 3, which are either components of the guide members 2 or are constructed as separate weaving reeds 3 and lie in the direction of rotation 1*a* or in the direction of the center of rotation 18 between the guide elements 2. A weft thread preparation device 6 supplies the weft threads on the weft input side 11 to the corresponding guide elements 2, which contain a weft channel 202 and also an aperture 201 in the weft channel. Several weft threads 41 to 44 are simultaneously inserted pneumatically through the weft channels 202 of the guide elements 2 into the open weaving sheds 51. On the weft input side 11 there is a weft holding device 11*a* for the insertion side, and on the weft output side 12 there is a weft holding device 12*a* for the weft output side.

Figure 2:
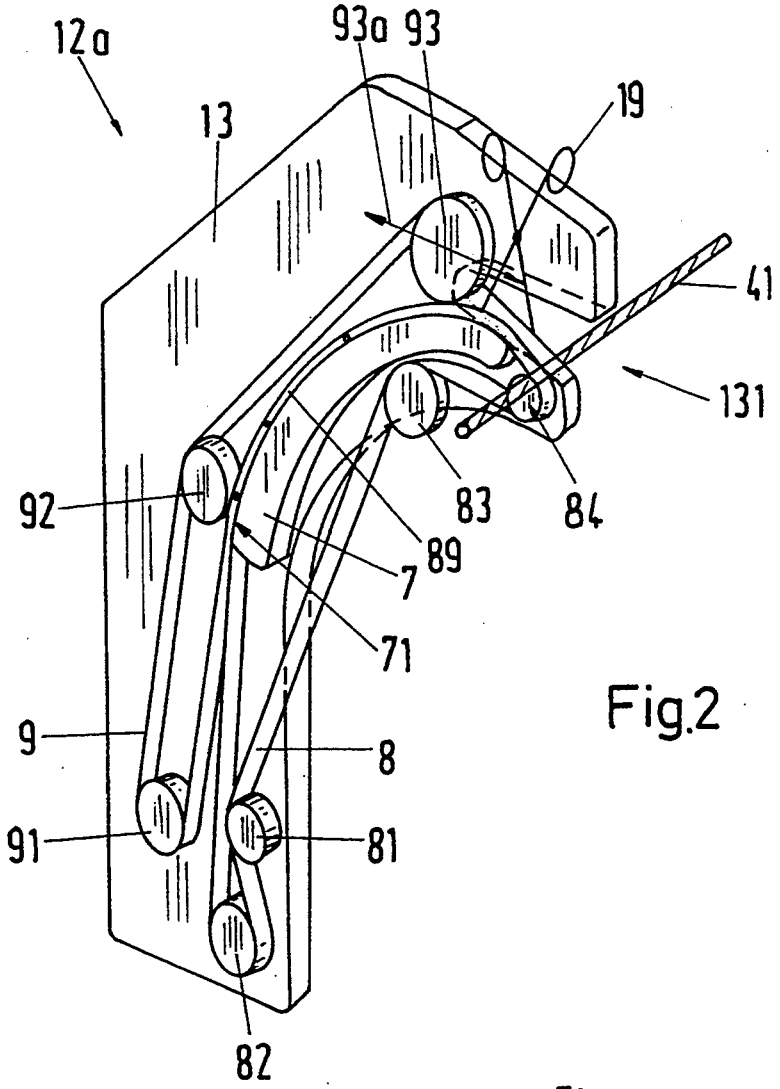
FIG. 2 shows a detailed sketch of a perspective view of a weft holding device.

The weft holding device 12*a* represented in perspective in FIG. 2 consists of a retaining plate 13, on which a support member 7 and also belt pulleys 81 to 84 are disposed, which support an inner conveyor belt 8. An outer conveyor belt 9 is deviated by the belt pulleys 91 to 93. The conveyor belt 8 slides on the surface 71 of the support member 7 over a curved path. The conveyor belt 9 lies on the conveyor belt 8 at least in sub-regions of the guide surface 71, as a result of which a clamping slot 89 is produced between the two conveyor belts 8 and 9. The retaining plate 13 comprises a weft inlet centering device 131 on the inlet side of the weft thread 41, by which the weft thread 41 is guided to the inlet slot 891 of the two conveyor belts 8 and 9. As soon as the weft thread 41 is clamped on the weft input side 11 in the clamping slot 89, the weft thread 41 is cut by a cutter 19. On the weft output side 12 a suction and discharge nozzle 10 ensures that a weft thread 41 entering the weft holding device 12*a* remains stretched until it comes to lie in the clamping slot 89 between the conveyor belts 8 and 9. The weft thread end protruding at the weft output side is also normally cut by a cutter 19 after clamping.

The conveyor belts 8 and 9 can be driven individually by a separate motor drive, e.g. by the drive of the belt pulleys 82 and 91. It is also possible to drive just the conveyor belt 8, the conveyor belt 9 being driven by the friction in the region of the clamping slot 89 on the conveyor belt 8, for example.

The reciprocal friction of the conveyor belts 8 and 9 should advantageously be selected so that no relative movement occurs in the region of the clamping slot 89 between the conveyor belts 8 and 9.

Instead of an independent drive, the conveyor belt 8 may be wound around the rotor 1 so that they touch, for example outside the shedding region of the rotor, thus on a continuation of the shaft of the rotor (not shown). The conveyor belt 8 can be driven in this way directly by the rotor 1. In a further embodiment both the conveyor belt 8 and also the conveyor belt 9 are wrapped around the rotor 1. In this case the outer conveyor belt 9 is to be guided, e.g. by means of belt pulleys, so that the weft insertion is not impeded.

The position of the belt pulley 93 can be moved backwards and forwards and fixed roughly parallel to the path of the weft thread 41 entering the clamping slot 891, as shown in FIG. 2 by arrows 93*a*. Thus the geometric position of the inlet slot 891, in particular the position of the point at which the weft thread 41 is securely clamped, is adjustable. Other possibilities of adjusting individual belt pulleys are not shown, e.g. to alter the tensile stress of the conveyor belts or to facilitate exchange.

The weft threads are held inside the clamping slot 89 on both sides by the two weft holding devices 11*a*, 12*a*. A weft thread being inserted through the weft channel 202 is braked until it stops, depending on the design of the stop device, e.g. by friction in the clamping slot 89 on the weft input side. The surface of the conveyor belts 8 and 9 close to the clamping slot 89 preferably comprises a surface finish which, in conjunction with the respective type of weft threads, brings about high sliding and static friction. The rear surface of the conveyor belts, in particular the side of the conveyor belt 8 lying on surface 71, requires favorable sliding properties with respect to the supporting surface 71 in the embodiment shown.

Figure 5:
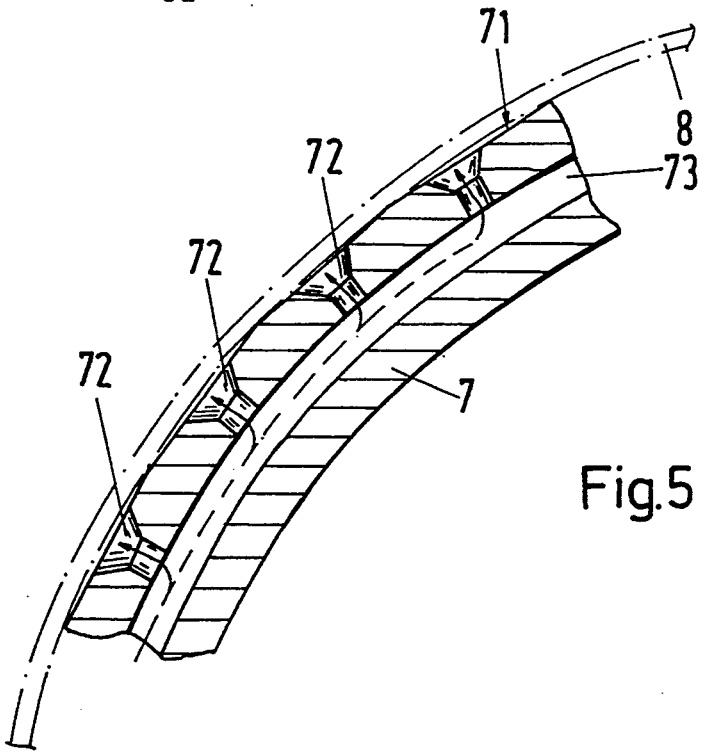
FIG. 5 shows a detail of the support member with outlet apertures.
Figure 4:
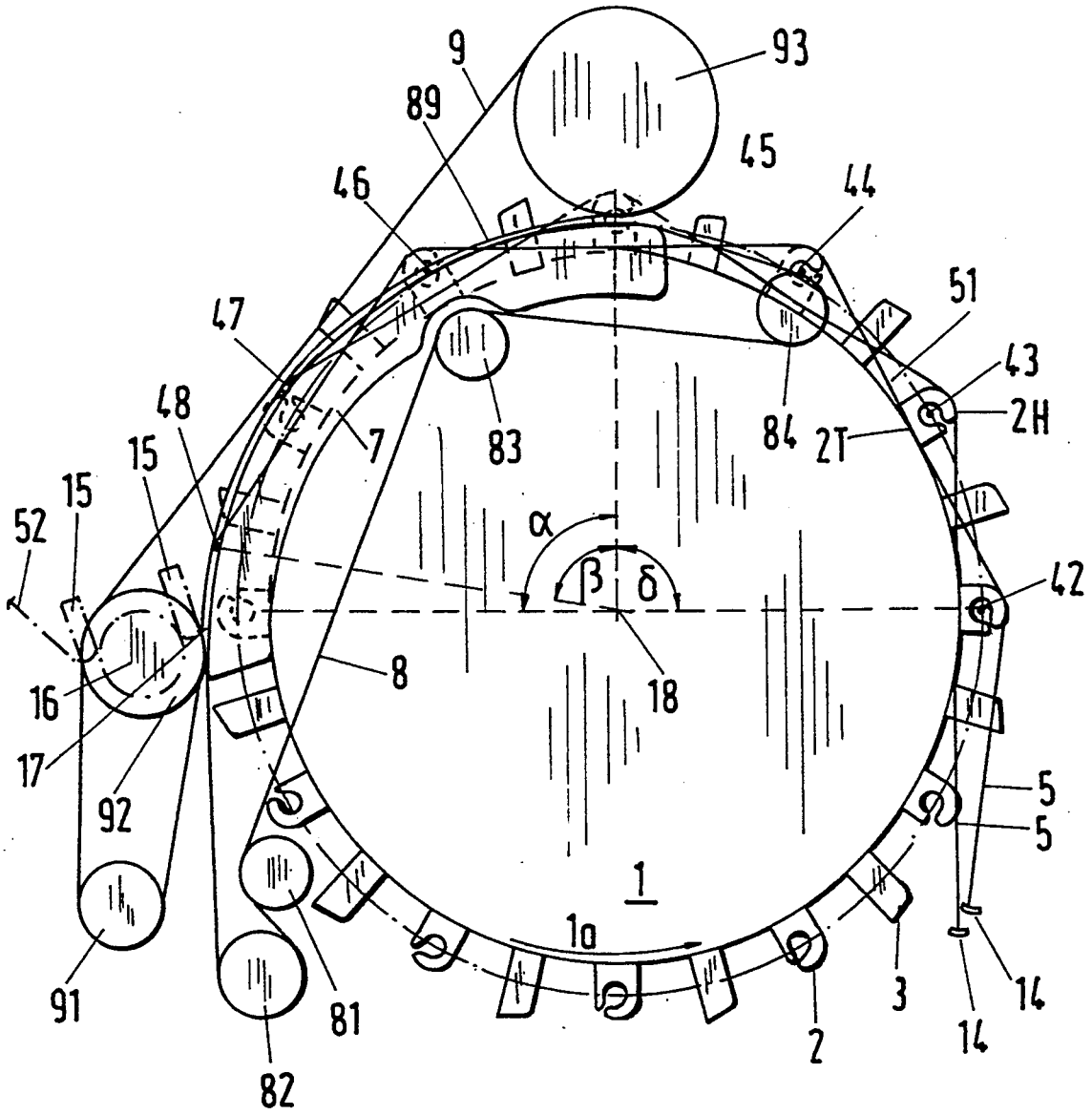
FIG. 4 diagrammatically shows a lateral view of the rotor and also of the weft holding device.

FIG. 5 shows an exemplified embodiment for reducing further the friction of the conveyor belt 8 on the support member 7 by an intermediate layer which reduces the friction, for example by means of a fluid such as air, being produced between the surface 71 of the support member and the conveyor belt 8. The fluid supplied via supply ducts 73, e.g. air, exits via outlet apertures 72 integrated in the surface 71, as a result of which an air cushion reducing the friction is formed. The support surface 71 is constructed as a polygonal course in the exemplified embodiment in FIG. 5, with an outlet aperture 72 lying in a plane surface. Air pockets reducing friction are formed over the surfaces. FIG. 4 shows the rotor 1 in a diagrammatical view with the guide elements 2 and also with the reeds 3. The laying elements 14 lay the warp threads 5 into the corresponding high points 2H and low points 2T, so that open weaving sheds 51 are produced, into which a weft thread 42–44 can be inserted. In the rotor 1 rotating in the direction of rotation 1*a* the weaving sheds 51 in the range of the weft insertion angle 8 are opened so that a weft thread can be inserted without hindrance between the warp threads 5. The weft threads 42 to 44 are inserted into the corresponding weaving sheds 51 at the same time, according to the known principle of pneumatic insertion in series-shed looms, the weft thread points of the individual weft threads 42 to 44 penetrating the weft channel 202 further towards the weft output side 12 with the corresponding rotation of the rotor 1 in the direction of rotation 1*a*. Towards the end of the range of the weft insertion angle 6 the weft thread 45 has to have reached the weft output side 12 and is normally grasped, held and stretched there by a suction and discharge nozzle 10. The weft thread 45 enters the inlet slot 891 and normally is braked first of all on the insertion side by the weft holding device 11*a*, between the conveyor belts 8 and 9 in the clamping slot 89, and cut with the thread cutter 19 on the insertion side. The weft thread 45 normally stretched slightly in the direction of insertion by the braking operation enters the inlet slot 891 on the weft output side, rotating in direction 1*a*, in the weft holding device 12*a*, is clamped in the clamping slot 89 between the conveyor belts 8 and 9 and thus also held on the weft output side 12 and cut with the thread cutter 19. The weft thread therefore is preferably slightly stretched between the two weft holding devices 11*a* and 12*a*. The inlet slot 891 on the weft output side and thus the start of the clamping slot 89 advantageously lies displaced by a few angle degrees up to fractions of an angle degree in the direction of rotation 1*a* with respect to the inlet slot 891 on the insertion side.

Figure 3:
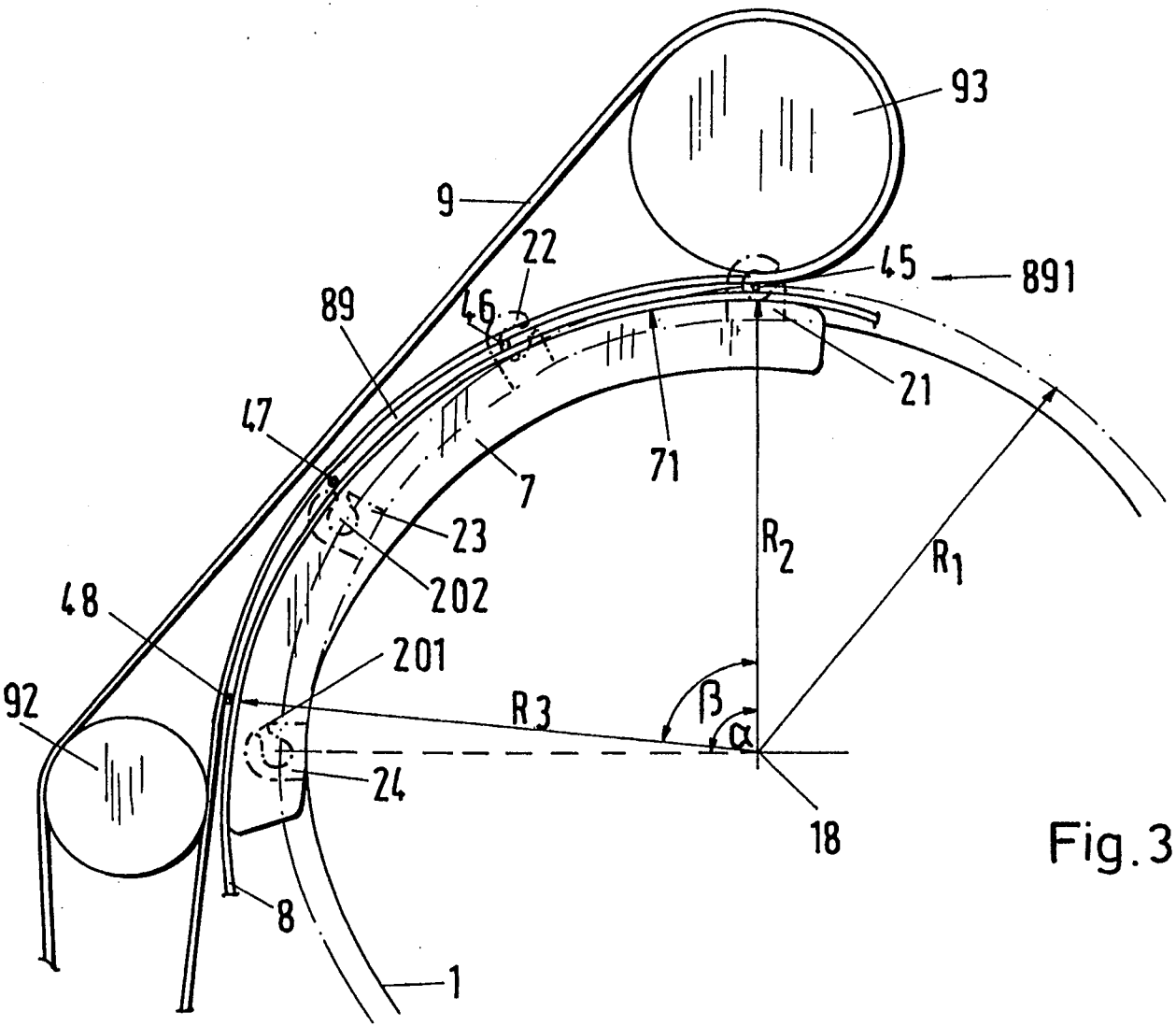
FIG. 3 shows as a detail a diagrammatical lateral view of the rotor and also of the weft holding device.

The rotor 1 normally rotates at a constant angular velocity. The angular velocity of the conveyor belts 8 and 9 along the periphery of the rotor and the angular velocity of the clamping slot 89 respectively is normally synchronised with the angular velocity of the rotor 1. So as to beat up the inserted weft threads at the beat-up edge 17, it is necessary to convey the weft thread 45 through the aperture 201 out of the weft channel 202. This operation is shown in detail in FIG. 3. The center of the weft channel 202 rotates according to the radius R1 at a normally constant angular velocity. According to the curved path of surface 71 of the support member 7, its distance to the center of rotation 18 of the rotor increases from the radius R2 to the radius R3, the angular velocity of the clamping slot 89 with respect to the center of rotation 89 becomes increasingly slower inside the angle of rotation $\alpha$ in the direction of rotation 1*a*. In the present exemplified embodiment the course of the angular velocity of the clamping slot 89 is selected by the geometry of the surface 71, and also the drive of the conveyor belt 8, so that after the weft thread 45 has been clamped on both sides in the clamping slot 891, the weft thread 45 moves faster relative to the weft channel 202 because of the radius R2, which is smaller than the radius R1. Therefore after a corresponding rotation of the rotor 1, as shown with weft thread 46, the weft thread comes to lie in the weft channel 202 displaced towards the knock-off 17. The further the surface 71 is from the center of rotation 18, the more strongly the angular velocity of the clamping slot 89 drops at the corresponding position. The weft thread 47 moving at a slower angular velocity in comparison with the rotor 1 and also with the guide element 23 lags behind the guide element 23, simultaneously arrives at a higher orbit and as a result slides through the aperture 201 of the weft channel 202. In the same period in which the rotor covers an angle of rotation $\alpha$ in the direction of rotation 1*a*, the weft thread 48 covers a smaller angle of rotation D. Inside the range of the angle of rotation $\alpha$, the weft thread is transported from radius $R_2$ onto the larger radius $R_3$ with respect to the center of rotation 18 of the rotor. The weft thread 48 can now be beaten up by a reed 3 at the beat-up edge 17 without being obstructed by guide elements 23. The fabric is normally led away over a fabric support 15 and a fabric stretcher 16. The course of the angular velocity of the clamping slot 89 over the support member 7 can naturally be varied in wide ranges, e.g. by the arrangement of the support member 7 and/or by the curved course of the surface 71, and also by the drive velocity of the conveyor belt 8, so that the exemplified embodiment shown in FIG. 3 only represents one solution from a variety of possible solutions. Thus the course of the surface 71 may also comprise plane surfaces and/or edges.

In a further advantageous embodiment the angular velocity of the clamping slot 89 is already lower at the inlet slot 891 than the angular velocity of the guide elements 21 to 24, with the angular velocity of the clamping slot 89 being further reduced with respect to the center of rotation 18 in the direction of rotation 1*a*.

In the present exemplified embodiment the range of the angle of rotation $\beta$, in which weft threads 45 to 48 are actively moved clamped on both sides, is in the order of magnitude of 90°. However the range of the angle of rotation $\beta$ may lie within a range of between 20° and 180° according to the supporting surface 71 selected. Normally the clamping slots 89 on the weft input side and also on the weft output side extend parallel to one another. So that an additional stretching of the weft threads is achieved, it may be advantageous if the distance between the two clamping slots 89 increases in the direction of rotation 1*a*, at least in the angle of rotation range $\beta$.

The conveyor belt 8 and/or 9 may, as mentioned, be driven by the fact that it is wound around the rotor 1 and lies thereon at an appropriately provided position. On the periphery of the rotor 1 or to the side on an extended shaft may be mounted a storage unit, in which at least one endless reserve conveyor belt wound around the shaft or the rotor is housed, so that a defective conveyor belt 8 and/or 9 can be quickly replaced.

Figure 6:
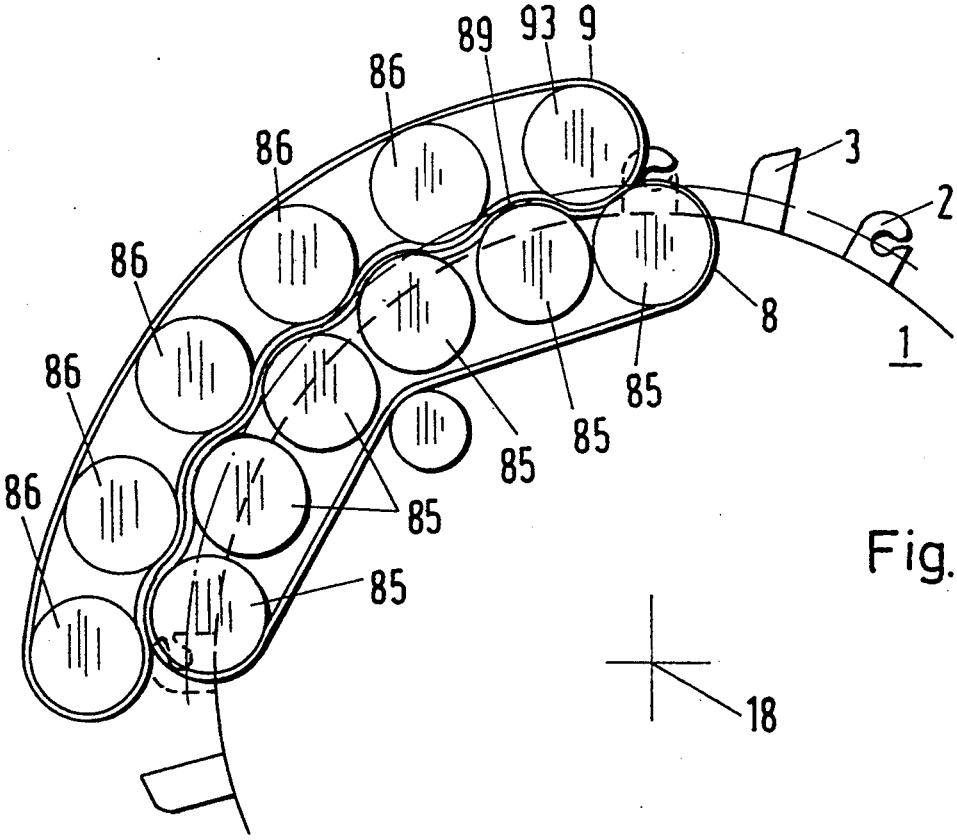
FIG. 6 shows a further embodiment of a weft holding device.

FIG. 6 shows a further exemplified embodiment for arranging the conveyor belts 8 and 9 and also the clamping slot 89. The conveyor belt 8 lies on belt pulleys 85 instead of on the support member 7, the spacing of the center of rotation of the individual pulleys 85 increasing in the direction of rotation with respect to the center of rotation 18 so that the weft thread is conveyed on a higher path, similarly as with support member 7. A waviness of the clamping slot 89 caused by the belt pulleys 85 and 86, 93 superimposes this path.

Figure 7:
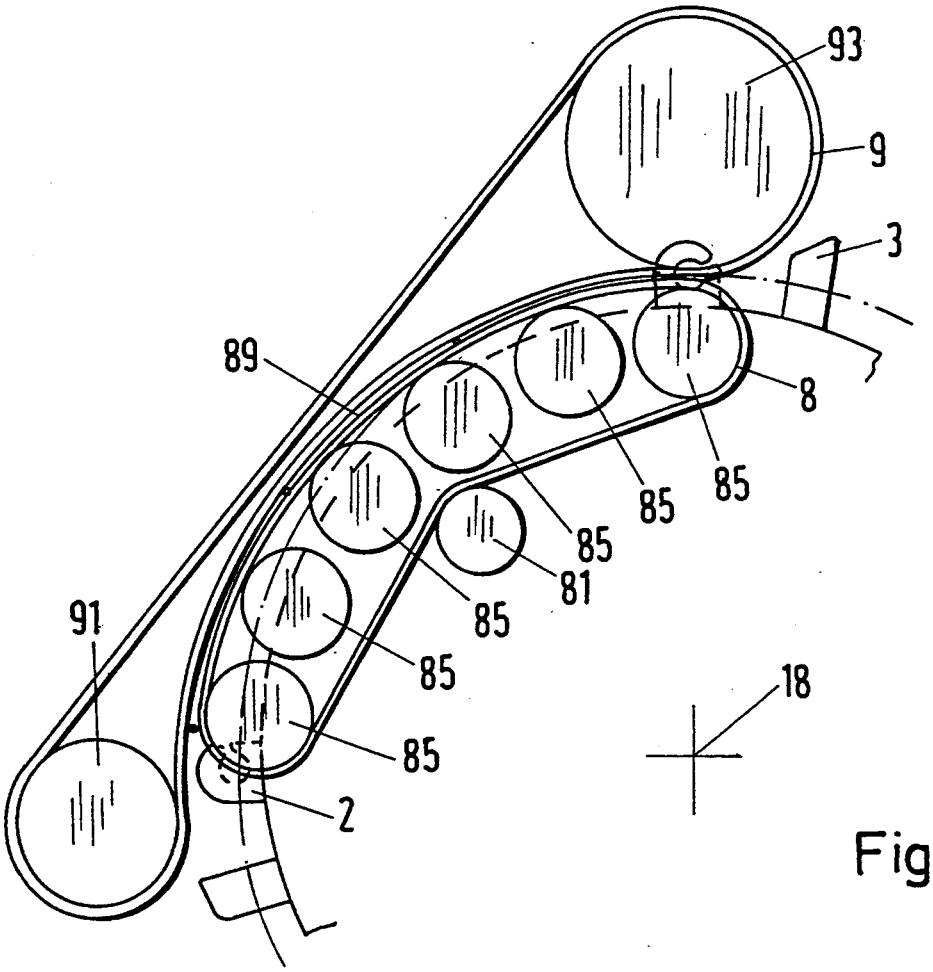
FIG. 7 shows a further embodiment of a weft holding device.

FIG. 7 shows a further exemplified embodiment for storing the conveyor belts 8 and 9, in which the superimposed waviness is reduced by the fact that only conveyor belt 8 is stored on several belt pulleys 85.

Figure 8:
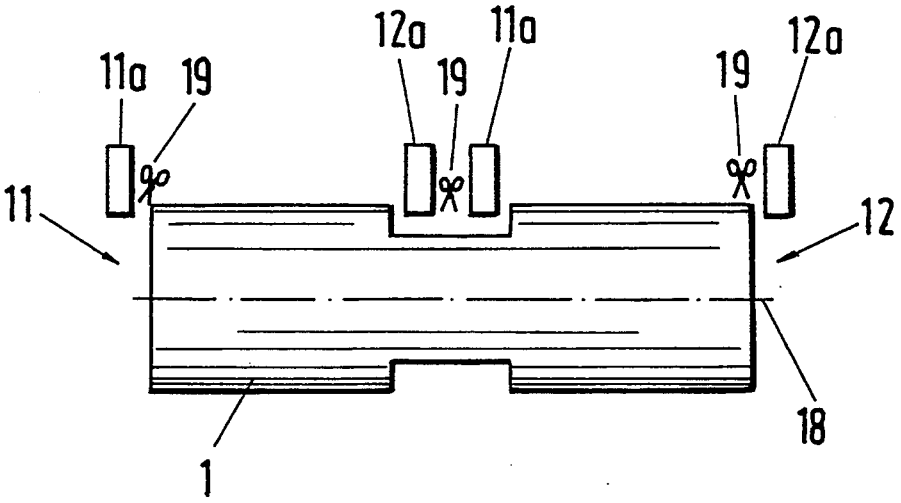
FIG. 8 shows an embodiment of a rotor which permits a multi-panel weaving operation on a rotor.

FIG. 8 diagrammatically shows a longitudinal section through a rotor 1, which is designed so that multi-panel weaving is possible. With the exemplified embodiment shown two-panel weaving is possible by guide elements 2 and reeds 3 being provided in the central region of the rotor so that a weft holding device 12*a* with cutting device 13 and also a weft holding device 11*a* can be disposed. A weft thread is inserted over the entire length of the rotor 1, held by the pair of weft holding devices 11*a*, 12 close to the weft insertion side 11 and simultaneously or subsequently cut by three cutters 19. The cutter 13 located inside the rotor 1 between the individual fabric widths may also be omitted if the fabric widths are separated at another position, e.g. after the support 15. In the exemplified embodiment shown in FIG. 8 further pairs of weft holding devices 11*a*, 12*a* and also cutting devices—if necessary—can also be disposed along the longitudinal axis of the rotor, so that by means of a rotor 1 more than two fabric widths can be simultaneously woven next to one another.

I claim:

1. A device for holding weft threads of a series-shed loom between a weft input side and a weft output side of a rotating rotor of said series-shed loom rotating in a direction of rotation from a weft thread insertion angle to a weft thread discharge angle about a central axis of rotation, said device for holding weft threads comprising:

at least one weft thread holding device on the input side and one weft thread holding device on the output side of said rotor;

at least one cutting device at least on the input side of said rotor for severing inserted weft threads;

each said weft thread holding device including means for clamping at least one weft thread end whereby a weft thread is clamped at a first end on said input side and at a second end at the output side and is held between said devices;

each said means for clamping including a support member defining a supporting surface extending substantially parallel to the central axis of rotation of said rotor of said series shed loom;

each said means for clamping further including two endless conveyor belts laying over one another at least inside an angle $\beta$ of partial revolution of said rotor between said weft thread insertion angle to said weft thread discharge angle;

said two conveyor belts guided over guide rollers so that an inlet slot for weft threads is produced in conjunction with said supporting surface;

means moving said conveyor belts to capture said weft threads in the direction of rotation of said rotor; and, the distance of the supporting surface increasing within said angle of rotation $\beta$ from a distance $R_2$ to a greater distance $R_3$, whereby a weft thread gripped between aid clamping slots moves away with respect to the center of rotation of said rotor to said discharge angle with respect to said rotating rotor.

2. A device for holding weft threads of a series-shed loom between the weft input side and the weft output side of a rotating rotor of said series-shed loom rotating about a central axis of rotation according to claim 1 and wherein:

each said means for clamping further includes a support member defining a supporting surface, said supporting surface defined in a plane in the direction of rotation of said rotor; and, said at least one weft thread holding device on the input side and said at least one weft thread holding device on the output side of said rotor moves said weft thread in said plane inside the angle of rotation $\beta$ of said rotor.

3. SA device for holding weft threads of a series-shed loom between the weft input side and the weft output side of a rotating rotor of said series-shed loom rotating about a central axis of rotation according to claim 1 and wherein:

said supporting surface includes a plurality of straight line surfaces in the direction of rotation of said rotor.

4. A device for holding weft threads of a series-shed loom between the weft input side and the weft output side of a rotating rotor of said series-shed loom rotating about a central axis of rotation according to claim 1 and wherein:

said support surface includes a curved path and the weft thread moves on said curved path inside the angle of rotation $\beta$.

5. A device for holding weft threads of a series-shed loom between the weft input side and the weft output side of a rotating rotor of said series-shed loom rotating about a central axis of rotation according to claim 1 and wherein:

said rotor includes four or more weft holding devices which are disposed in pairs beside one another with each pair including cutting devices lying between the pairs so that multi-panel weaving is performed.

6. A device for holding weft threads of a series-shed loom between the weft input side and the weft output side of a rotating rotor of said series-shed loom rotating about a central axis of rotation according to claim 1 and wherein:

fluid supply ducts are disposed inside the support member with outlet apertures to the supporting surface so as to produce a friction-reducing layer of fluid between the supporting surface and the conveyor belt.

7. A device for holding weft threads of a series-shed loom between the weft input side and the weft output side of a rotating rotor of said series-shed loom rotating about a central axis of rotation according to claim 6 and wherein:

said supporting surface is constructed as a polygonal course, which is formed by several plane surfaces, with each plane surface at least one outlet aperture therein.

8. A device for holding weft threads of a series-shed loom between the weft input side and the weft output side of a rotating rotor of said series-shed loom rotating about a central axis of rotation according to claim 1 and wherein:

said support member with said supporting surface consists of several belt pulleys disposed in the direction of rotation of said rotor along the periphery of the rotor.

9. A device for holding weft threads of a series-shed loom between the weft input side and the weft output side of a rotating rotor of said series-shed loom rotating about a central axis of rotation according to claim 1 and wherein:

several belt pulleys supporting the outer conveyor belt are disposed by roughly a half a pitch in the direction of rotation so that a wavy clamping slot is produced.

10. A device for holding weft threads of a series-shed loop between the weft input side and the weft output side of a rotating rotor of said series-shed loom rotating about a central axis of rotation according to claim 1 and wherein:

said conveyor belt adjacent said rotor is wound around the rotor to be driven by said rotor.

11. A device for holding weft threads of a series-shed loom between the weft input side and the weft output side of a rotating rotor of said series-shed loom rotating about a central axis of rotation according to claim 1 and wherein:

guide elements for gripping said thread, said guide elements rotating to move corresponding to the radius R1 at a constant angular velocity; and, said conveyor belts moving at an angular velocity with respect to said rotor over said supporting surface with said weft thread clamped by the conveyor belts has said angular velocity of said weft thread reduced between inlet slot and a beat-up edge depending on the increasing distance between the support surface and the center of rotation.

12. A device for holding weft threads of a series-shed loom between the weft input side and the weft output side of a rotating rotor of said series-shed loom rotating about a central axis of rotation according to claim 1 and wherein:

said means moving said conveyor belts to capture said weft threads in the direction of rotation of said rotor moves said belts at a speed so that after entering the inlet slot the angular velocity of clamped weft thread is at first greater than the angular velocity of the rotor but in passing over said supporting surface falls below the angular velocity of the rotor inside the angle of rotation.

13. A device for holding weft threads of a series-shed loom between the weft input side and the weft output side of a rotating rotor of said series-shed loom rotating about a central axis of rotation according to claim 1 and wherein:

the touching surfaces of the conveyor belts define a high coefficient of friction, whereas the other surfaces of the conveyor belts define a relatively smaller coefficient of friction.

14. A device for holding weft threads of a series-shed loom between the weft input side and the weft output side of a rotating rotor of said series-shed loom rotating about a central axis of rotation according to claim 1 and wherein:

said means for clamping said weft thread entering the inlet lot on the insertion side includes the conveyor belts; and, friction means between said conveyor belts for stopping said weft thread on the insertion side under said friction.

15. A device for holding weft threads of a series-shed loom between the weft input side and the weft output side of a rotating rotor of aid series-shed loom rotating about a central axis of rotation according to claim 1 and wherein:

said means for clamping the weft thread entering the inlet slot is the conveyor belts on the insertion side and said means for clamping the weft thread on the output side is the conveyor belts on the weft output side.

16. A device for holding weft threads of a series-shed loom between the weft input side and the weft output side of a rotating rotor of said series-shed loom rotating about a central axis of rotation according to claim 1 and wherein:

means for adjusting the belt pulley lying at the inlet slot with respect to the guide surface.

17. A device for holding weft threads of a series-shed loom between the weft input side and the weft output side of a rotating rotor of said series-shed loom rotating about a central axis of rotation according to claim 1 and wherein:

a plurality of several conveyor belts are wound around the rotor.

18. A device for holding weft threads of a series-shed loom between the weft input side and the weft output side of a rotating rotor of said series-shed loom rotating about a central axis of rotation according to claim 1 and wherein:

the clamping points of at least one weft thread clamped on both sides move in paths which extend in a plane normal to the center of rotation of said rotor.

19. A device for holding weft threads of a series-shed loom between the weft input side and the weft output side of a rotating rotor of said series-shed loom rotating about a central axis of rotation according to claim 1 and wherein:

said clamping means including means for increasing the distance between the clamping points of at least one weft thread clamped on both sides in the direction of rotation of said rotor.

* * * * *